United States Patent [19]

Hinata et al.

[11] 3,953,215

[45] Apr. 27, 1976

[54] SILVER HALIDE PHOTOGRAPHIC EMULSIONS

[75] Inventors: Masanao Hinata; Haruo Takei; Akira Sato; Masao Takano; Nobuaki Miyasaka, all of Minami-ashigara, Japan

[73] Assignee: Fuji Photo Film Co., Ltd., Minami-ashigara, Japan

[22] Filed: July 16, 1974

[21] Appl. No.: 489,013

[30] Foreign Application Priority Data

July 16, 1973 Japan ..... 48-80110

[52] U.S. Cl. ..... 96/124; 96/82; 96/132

[51] Int. Cl.[2] ..... G03C 1/14

[58] Field of Search ..... 96/124, 131, 82, 132

[56] References Cited

UNITED STATES PATENTS

| | | | |
|---|---|---|---|
| 3,038,800 | 6/1962 | Luckey et al. | 96/124 |
| 3,125,448 | 3/1964 | Heseltine et al. | 96/131 |
| 3,667,960 | 6/1972 | Shiba et al. | 96/124 |
| 3,737,313 | 6/1973 | Rosecrants et al. | 96/82 |
| 3,769,024 | 10/1973 | Sakazume et al. | 96/124 |

*Primary Examiner*—J. Travis Brown

*Attorney, Agent, or Firm*—Sughrue, Rothwell, Mion, Zinn & Macpeak

[57] ABSTRACT

A silver halide photographic emulsion containing in a supersensitizing amount the combination of at least one sensitizing dye represented by the general formula (I)

$(X_1^-)_{n-1}$ (I)

wherein, $A_1$, $A_2$, $A_3$ and $A_4$ each represents a member selected from the group consisting of a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamide group, an acyloxyl group, an alkoxycarbonylamino group, and a carbalkoxy group; and $A_1$ and $A_2$ and $A_3$ and $A_4$ can combine to form a naphthoxazole nucleus; $R_o$ represents a hydrogen atom, a lower alkyl group or an aryl group; $R_1$ and $R_2$ each represents an alkyl group, provided that at least one of $R_1$ or $R_2$ represents a sulfoalkyl group; $X_1$ represents an anion; and *n* is equal to 1 or 2 with n being equal to 1 when the sensitizing dye forms an intromolecular salt, and at least one sensitizing dye represented by the general formula (II)

$(X_2^-)_{m-1}$ (II)

wherein, $Z_1$ and $Z_2$ each represents the non-metallic atoms necessary to form a nucleus selected from the group consisting of a thiazole nucleus, a thiazoline nucleus, an oxazole necleus, a selenazole nucleus, a 3,3-dialkylindolenine nucleus, and an imidazole nucleus; $R_3$ and $R_4$ each represents an alkyl group; $X_2$ represents an anion; m is equal to 1 or 2 with m being equal to 1 when the sensitizing dye forms an intramolecular salt.

11 Claims, 2 Drawing Figures

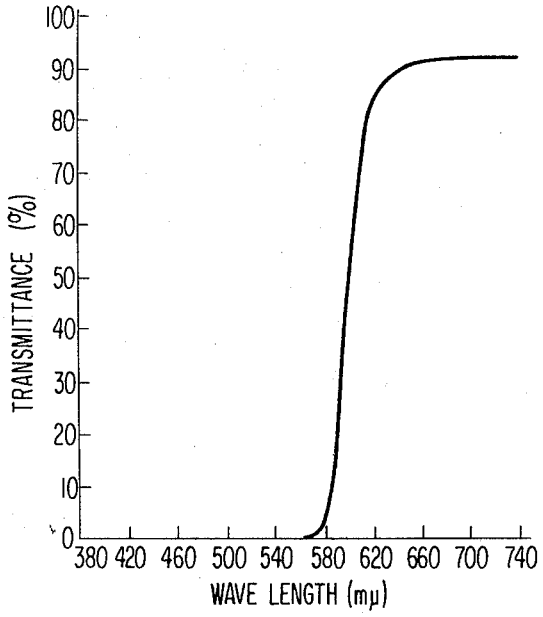
FIG. 1
FIG. 2
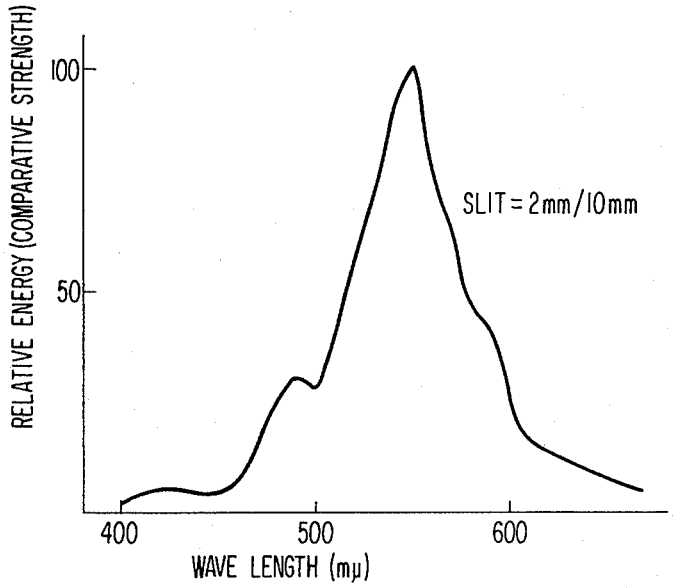

SILVER HALIDE PHOTOGRAPHIC EMULSIONS

BACKGROUND OF THE INVENTION

1. Field of the Invention

This invention relates to spectrally sensitized silver halide photographic emulsions and, more particularly, to those supersensitized with combinations of sensitizing dyes. Still, more particularly, the invention relates to emulsions having a markedly increased spectral sensitivity in the green region of the spectrum.

2. Description of the Prior Art

In the technical field of the production of photographic materials, it is well known to spectrally sensitize emulsions in order to extend the spectral response to a longer wavelength. In these sensitization techniques, sensitization at the green region is especially important partly because the maximum sensitivity of human vision lies at about 545 nm with the human eye being most sensitive to light in the green region.

In the field of radiography, an intensifying screen or a fluorescent panel is frequently employed in combination with a silver halide photographic film in order to increase the recording sensitivity. Many attempts have been made to improve the recording speed for X-ray radiation, which will result in the prevention of harmful effects to the human body accompanied by an excessive X-ray dosage, an improved detection of fine details with a smaller dosage, and also in an extension of the X-ray recording range. Such attempts include, for example, development of techniques to improve the sensitivity of silver halide photographic emulsions, development of systems employing X-ray image intensifiers and development of systems employing solid-state X-ray amplifiers. It should be noted, however, that in all of these systems the final process is to record a fluorescent light image onto a silver halide photographic material.

Fluorescent materials used for the present purpose include blue light emitting materials such as barium sulfate activated with strontium, barium sulfate activated with lead, barium sulfate activated with silver, calcium tungstate activated with lead, zinc sulfide activated with silver, and barium phosphate ($Ba_3(PO_4)_2$) activated with europium, and green light emitting materials such as zinc-cadmium sulfide activated with silver.

Recently oxy-sulfides of yttrium or of the lantanide elements activated with rare earth elements such as, for example, gadolinium oxy-sulfide activated with terbium ($Gd_2O_2S$) are known to fluoresce with a high emitting energy intensity as disclosed in Lockheed Aircraft Corporation research reports. Further, as other members of this family, lanthanum oxy-sulfide, yttrium oxysulfide, etc. are also described in U.S. Pat. Nos. 3,721,827, and 3,705,858.

On the other hand, the photo-sensitive x-ray recording materials used including direct and indirect x-ray recording materials should preferably be handled including developing and fixing operation under illumination conditions as bright as possible. As a matter of fact these x-ray recording photographic materials are processed and handled under a safe light provided with a No. 7 filter produced by Fuji Photo Film Co., which has the spectral transmitting curve shown in FIG. 1.

As is evident from the above descriptions, X-ray recording materials based on silver halide photographic emulsion must be highly sensitive to the light emitted by the x-ray excitation and at the same time weakly sensitive to the light used as a safe light.

With the arrival of the information age, an urgent need arose for the development of information transmitting systems with higher transmitting speeds, and many systems have been developed including, for example, press facsimile systems, high speed photo type setting systems, cathode ray tube (CRT) display systems, high speed photographic recording systems such as that employing holography, and photo mask printing systems for IC production. In the CRT display systems, a variety of fluorescent materials which emit light on the order of a microsecond are used. Each fluorescent material has at least one fluorescent energy peak in the spectrum; for example, P-2 fluorescent material has an energy peak at about 545 nm, P-4 at about 560 nm, P-22D at about 525 nm, P-31 at about 520 nm, and P-20 at about 560 nm, respectively.

The processing speed of photosensitive materials using a silver halide photographic emulsion is always increasing and now the period required for development and fixing has become as short as about 60 to 120 seconds. Such a short processing period has made it rather difficult for the sensitizing dye to be removed from the emulsion layer, thus causing a residual tint in the processed material due to residual dye. Such tinting is one of the factors deteriorating the quality of the final image.

Spectral sensitization in the green region is frequently accomplished using dyes selected from the merocyanine, hemicyanine and tri-nuclear cyanine dyes. However, all of these sensitizing dyes tend to give rise to too broad a spectral response, thus these dyes are inappropriate for sensitization in a narrow, particular range of the spectrum. In addition, the absolute degree of sensitivity is often insufficient; especially in the sensitization of a high-speed silver iodobromide photographic emulsion the degree of sensitization is unfortunately low. These sensitizing dyes also suffer from the lack of supersensitizers therefor. For the present purpose of sharp, narrow band sensitization, application of a J-aggregate cyanine dye is, as is already known, recommended. The following patents describe such techniques using dyes mentioned below, e.g., imidazolocarbocyanine dye as disclosed in U.S. Pat. Nos. 2,701,198, 2,945,763, 2,973,264, 3,173,791, 3,364,031, 3,397,060, 3,506,443, 3,617,294 and 3,663,210, Japanese Pat. application No. 4936/1968, and German (OLS) 2,011,879, and 2,030,326; imidaoxacarbocyanine dye as disclosed in Japanese Pat. application 14030/1969, and pseudo-isocyanine dye as disclosed in German (OLS) 1,936,262 and French Pat. 1,488,057.

Although some of these techniques can achieve a superior level of sensitivity, most of them tend to give too broad a spectral response and a residual tint above permissible levels, thus failing to be practiced industrially. A technique using styryl dyes as supersensitizers is known as described in, for example, British Pat. No. 498,031, German Pat. No. 1,051,116, U.S. Pat. Nos. 2,313,922, 2,316,268, 2,533,426 and 2,852,385. However, unfortunately only a very low sensitivity is obtained using this technique for an exposure on the order of a microsecond, i.e., a far briefer exposure time scale than the usual one. In other words, emulsions based on this technique suffer from a marked reciprocity law failure towards high intensity (brief) exposure.

SUMMARY OF THE INVENTION

A principal object of the present invention is to provide silver halide photographic emulsions having a high green sensitivity accompanied by little residual tint.

Another object of the present invention is to provide silver halide photographic emulsions suitable for producing medical x-ray recording photographic materials which are highly sensitive to the light emitted by green fluorescent materials and at the same time which are not fogged by a safe light.

Still another object is to provide silver halide photographic emulsions having little reciprocity law failure towards high intensity (brief) exposure and thus adapted for recording a CRT display.

Still a further object is to provide spectrally sensitized silver halide photographic emulsions with little residual tint and adapted for rapid processing not affected by the co-presence of an anti-fogging agent and a development accelerator. These and other various objects of the present invention will be understood from the following description of the present invention.

It has been found that the combinations of the two groups of spectral sensitizers represented by the following general formulae can efficiently achieve the various objects of the present invention cited above.

The present invention comprises a silver halide photographic emulsion containing in supersensitizing amounts the combination of at least one spectral sensitizer represented by the following general formula (I)

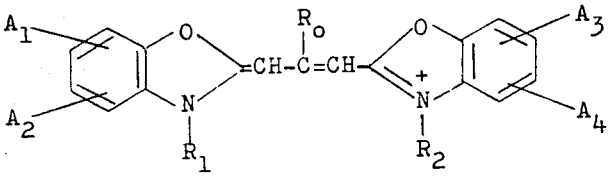

$(X_1^-)_{n-1}$ (I)

halide wherein, $A_1$, $A_2$, $A_3$ and $A_4$ each represents a member selected from the group consisting of a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamido group, an acyloxyl group, an alkoxycarbonylamino group, and a carbalkoxy group; and $A_1$ and $A_2$ and $A_3$ and $A_4$ can combine to form a naphthoxazole nucleus; $R_o$ represents a hydrogen atom, a lower alkyl group or an aryl group; $R_1$ and $R_2$ each represents an alkyl group, provided that at least one of $R_1$ or $R_2$ represents a sulfoalkyl group; $X_1$ represents an anion; and n is equal to 1 or 2 with n being equal to 1 when the sensitizing dye forms an intramolecular salt, in combination with at least one second spectral sensitizer represented by the following general formula (II)

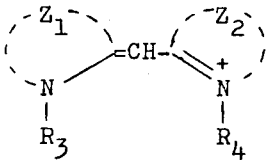

$(X_2^-)_{m-1}$ (II)

wherein, $Z_1$ and $Z_2$ each represents the non-metallic atoms necessary to form a nucleus selected from the group consisting of a thiazole nucleus, a thiazoline nucleus, an oxazole nucleus, a selenazole nucleus, a 3,3-dialkylindolenine nucleus, and an imidazole nucleus; $R_3$ and $R_4$ each represents an alkyl group; $X_2$ represents an anion; m is equal to 1 or 2 with m being equal to 1 when the sensitizing dye forms an intramolecular salt.

BRIEF DESCRIPTION OF THE DRAWINGS

FIG. 1 illustrates the spectral transmission curve of a safe light filter for use in a usual safe light for an x-ray photographic film.

FIG. 2 shows the spectral energy distribution curve for the fluorescent light emitted from a terbium activated gadolinium oxysulfide phosphor due to x-ray excitation.

DETAILED DESCRIPTION OF THE INVENTION

In the general formula (I), $A_1$, $A_2$, $A_3$ and $A_4$ each represents a member selected from the class consisting of a hydrogen atom, a lower alkyl group, preferably having 1 to 4 carbon atoms such as $-CH_3$, $-C_2H_5$ or $-C_3H_7(n)$, a halogen atom (e.g., Cl, Br, I, F), an alkoxy group preferably having a $C_1$ to $C_4$ alkyl moiety such as $CH_3O-$ or $C_2H_5O-$, a hydroxyl group, a mono-aryl group such as phenyl or sulfo substituted phenyl (for example, p-sulfophenyl), a carboxyl group, an alkoxycarbonyl group having a $C_1$ to $C_4$ alkyl moiety such as methoxycarbonyl or ethoxycarbonyl, a cyano group, a trifluoromethyl group, an amino group such as amino or a lower alkyl substituted amino group (for example, methylamino, or dimethylamino), an acylamido group such as acetamido, an acyl group such as acetyl, an acyloxyl group (e.g., acetoxy, etc.), an alkoxycarbonylamino group having preferably an alkyl moiety with 1 to 4 carbon atoms (e.g., ethoxycarbonylamino, etc.) or a carbalkoxy group having preferably an alkyl moiety with 1 to 4 carbon atoms (e.g., carboethoxy, etc.); further, $A_1$ together with $A_2$, and $A_3$ together with $A_4$, each represents an atomic group necessary to complete a naphthoxazole nucleus (e.g., naphtho(2,1-d)oxazole, naphtho(1,2-d)oxazole, naphtho(2,3-d)oxazole, etc.); $R_o$ represents a hydrogen atom, a lower alkyl group preferably with from 1 to 4 carbon atoms (e.g., $CH_3$, $C_2H_5$, etc.), or a monoaryl group (e.g., phenyl, etc.); $R_1$ and $R_2$ each represents an unsubstituted alkyl group preferably with from 1 to 8 carbon atoms or a substituted alkyl group which is usually included in conventional cyanine dyes, and which contains preferably from 1 to 4 carbon atoms in the alkyl moiety, including methyl, ethyl, n-propyl, vinylmethyl, a hydroxyalkyl group (e.g., 2-hydroxyethyl, 4-hydroxybutyl, etc.), an acetoxyalkyl group (e.g., 2-acetoxyethyl, 3-acetoxypropyl, etc.), an alkoxyalkyl group (e.g., 2-methoxyethyl, 4-butoxybutyl, etc.), a carboxyalkyl group (e.g., 2-carboxyethyl, 3-carboxypropyl, 2-(2-carboxyethoxy)ethyl, p-carboxybenzyl, etc.), a sulfoalkyl group (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[2-(3-sulfopropoxy)ethoxy]ethyl, 2-hydroxy-3-(3'-sulfopropoxy)propyl, p-sulfophenethyl, p-sulfobenzyl, etc.), an aralkyl group (e.g., benzyl, phenylethyl, etc.), etc., provided that at least one of $R_1$ and $R_2$ represents sulfoalkyl group; $X_1$ represents an anion usually used in cyanine dyes, including a mineral acid anion such as a chloride ion, bromide ion, iodide ion, thiocyanate ion, sulfate ion, perchlorate ion, and an organic acid anion such as a p-toluene sulfonate ion, methylsulfate ion, ethylsulfate ion, etc.; and $n$ represents a positive integer of 1 or 2 whereby $n$ is equal to 1 when the dye forms an intramolecular salt.

In the general formula (II), $Z_1$ and $Z_2$ each represents the non-metallic atom group necessary to complete any one of the following heterocyclic nuclei such as:

a. a thiazole nucleus, which can contain substituents such as a lower alkyl group, a monoaryl group, a halogen atom, a lower alkoxy group, a carboxy group, a lower alkoxycarbonyl group, a monoaralkyl group, trifluoromethyl group, hydroxyl group, etc., including, e.g., thiazole, 4-methylthiazole, 4-phenylthiazole, 4,5-dimethylthiazole, 4,5-diphenylthiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, naphtho(2,1-d)thiazole, naphtho(1,2-d)thiazole, naphtho(2,3-d)thiazole, 5-methoxynaphtho(1,2-d)thiazole, 7-ethoxynaphtho(2,1-d)thiazole, 8-methoxynaphtho(2,1-d)thiazole, 5-methoxy(2,3-d)thiazole, 5-methoxy(2,3-d)thiazole, etc.;

b. a thiazoline nucleus, which can contain substituents such as a lower alkyl group, etc., including, e.g., thiazoline, 4-methylthiazoline, etc.;

c. an oxazole nucleus, which can contain substituents such as a lower alkyl group, a halogen atom, a monoaryl group, a lower alkoxy group, trifluoromethyl group, a hydroxy group, a carboxy group, etc., including, e.g., oxazole, 4-methyloxazole, 4-ethyloxazole, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho(2,1-d)oxazole, naphtho(1,2-d)oxazole, naphtho(2,3-d)oxazole, etc.;

d. a selenazole nucleus, which can contain substituents such as a lower alkyl group, a monoaryl group, a halogen atom, a lower alkoxy group, a hydroxy group, etc., including, e.g., 4-methylselenazole, 4-phenylselenazole, benzoselenazole, 5-chlorobenzoselenazole, 5-methoxybenzoselenazole, 5-methylbenzoselenazole, 5-hydroxybenzoselenazole, naphtho(2,1-d)selenazole, naphtho(1,2-d)selenazole, etc.;

e. a 3,3-di(lower alkyl)indolenine nucleus, which can contain substituents such as a cyano group, a lower alkyl group, a halogen atom, etc., including, e.g., 3,3-dimethylindolenine, 3,3-diethylindolenine, 3,3-dimethyl-5-cyanoindolenine, 3,3-dimethyl-5-methoxyindolenine, 3,3-dimethyl-5-chloroindolenine, etc.;

f. an imidazole nucleus, which can contain substituents such as a lower alkyl group, a monoaryl group, a halogen atom, a lower alkoxy group, a cyano group, a trifluoromethyl group, an allyl group, etc., including, e.g., 1-methylimidazole, 1-ethylimidazole, 1-methyl-4-phenylimidazole, 1-ethyl-4-phenylimidazole, 1-methylbenzimidazole, 1-ethylbenzimidazole, 1-methyl-5-chlorobenzoimidazole, 1-ethyl-5-chlorobenzimidazole, 1-methyl-5,6-dichlorobenzimidazole, 1-ethyl-5,6-dichlorobenzomidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-ethylnaphtho(1,2-d)-imidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole, 1-phenyl-5,6-dichlorobenzimidazole, 1-phenyl-5-methoxybenzimidazole, 1-phenyl-5-cyanobenzimidazole, 1-phenylnaphtho(1,2-d)imidazole, etc.

$R_3$ and $R_4$ each represents an alkyl group like $R_1$ and $R_2$. $X_2$ is equivalent to $X_1$ representing an anion. $m$ is an integer of 1 or 2, wherein $m$ is 1 when the dye forms an intramolecular salt.

The present invention utilizes a supersensitizing combination comprising the "oxacarbocyanine dyes" represented by the general formula (I) and the "monomethine cyanine dyes" represented by the general formula (II). The spectral response provided by the monomethine dye represented by the general formula (II) by itself lies in a rather short wavelength region. In the case of silver iodo-bromide emulsion, the intrinsic spectral response of the silver halide extends to about 500 nm, which overlaps significantly the longest wavelength region spectrally sensitized by the present monomethine dyes. Thus, a high degree of sensitivity increase from the spectral sensitization would be hardly expected.

On the other hand, the oxacarbocyanine dyes represented by the general formula (I), especially when they are substituted with a halogen atom at the 5-position or include a phenyl- or methyl-substituted benzoxazole nucleus, tend by themselves to form J-aggregates with a sharp J-band absorption.

The J-band sensitization by the oxacarbocyanine dye cited above has proved to be enhanced by the co-existence of the monomethine dye represented by the general formula (II). When the amount of the dye represented by (II) is small relative to that of the dye represented by (I), i.e., less than about ¼ in molar ratio, the J-band sensitization tends to be enhanced; above a molar ratio of about ¼ the J-aggregate is adequately partitioned and the spectral absorption band shifts towards the blue, thus coinciding better with the energy distribution of fluorescent materials. At the same time, the emulsion become less sensitive to a safe light. Since the sensitivity of the emulsion reaches its maximum at a relatively low dye concentration, the residual tint is advantageously low. Generally speaking the residual tint due to the sensitizing dye tends to increase steeply when the dye concentration increases so as to form a stable aggregate. Considering such a general tendency, one can readily understand the essential, advantageous feature of the dye combinations of the present invention.

As another feature of the present invention, which is not, of course, limited by the silver halide composition of the emulsion, an especially intense supersensitizing effect is realized with silver iodobromide emulsions containing iodine at a content not higher than 4 mol%.

Such emulsions are advantageously used for X-ray recording photographic materials.

The combined sensitizing dyes of the present invention can advantageously be used to spectrally sensitize silver halide emulsions which are utilized in a variety of color and black-and-white photographic materials. The emulsions include e.g., those for color positive films, negative color films, reversal color materials, both with and without couplers, such as are described in U.S. Pat. No. 2,983,606, those containing dye developers, those containing diffusible dye forming couplers such as are described in U.S. Pat. No. 3,227,550, those suitable for the silver dye bleach process which are described in Friedman, History of Color Photography, especially, Chapter 24, American Photographic Publishers Co. (1944) and in British Journal of Photography, 111, 308–309 (April 7, 1964), or those for black-and-white photographic materials.

Some typical examples of the oxacarbocyanine dye which can be used in the present invention are described below. However, the scope of the present invention is not to be construed as being limited to these examples only.

I - 1

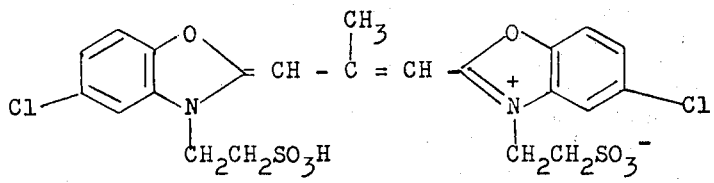

I - 2

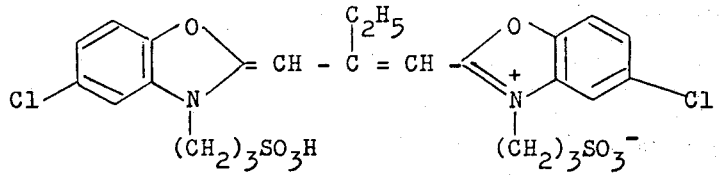

I - 3

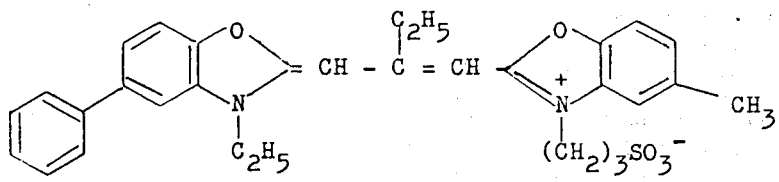

I - 4

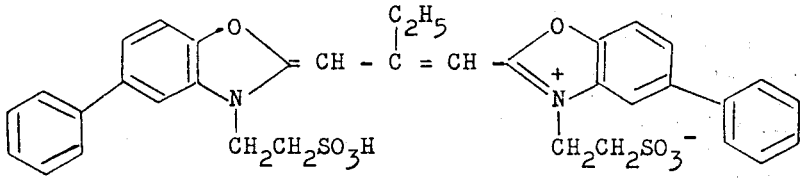

I - 5

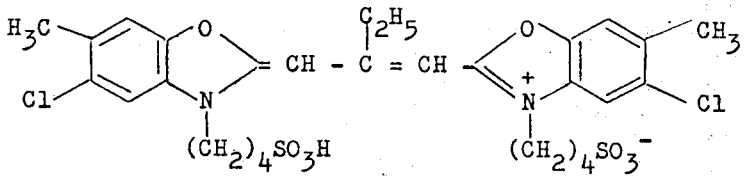

I - 6

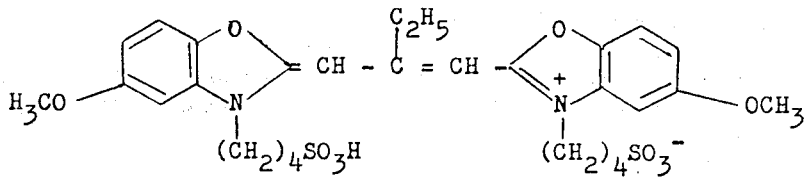

I - 7
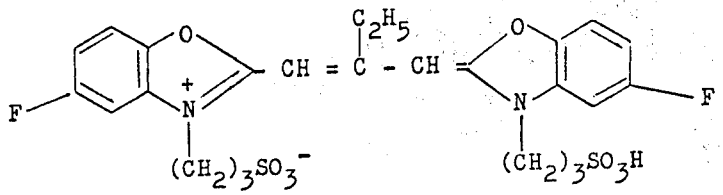
I - 8
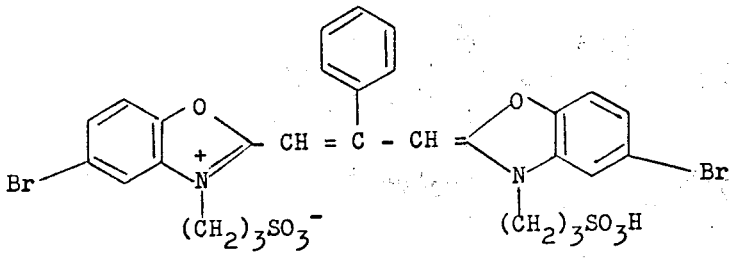
I - 9
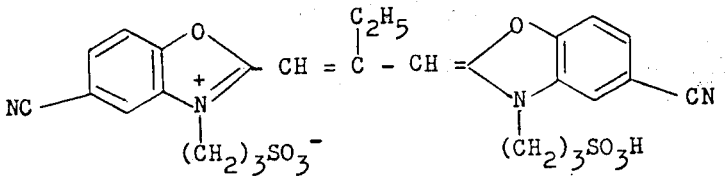
I - 10
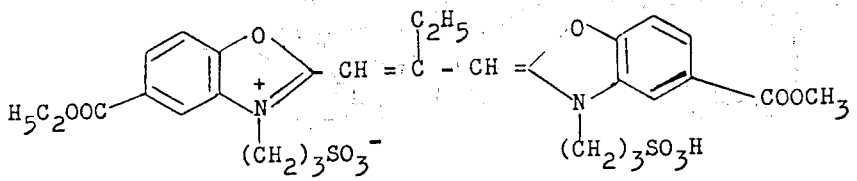
I - 11
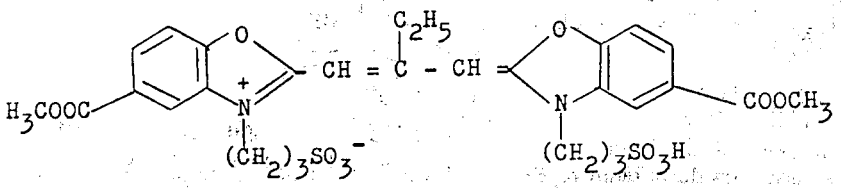
I - 12
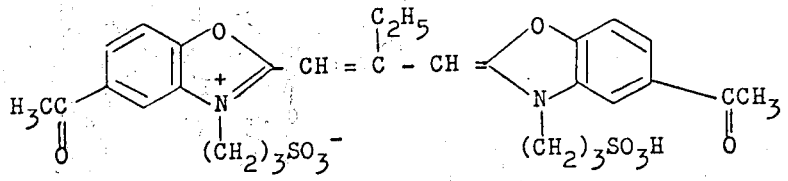
I - 13
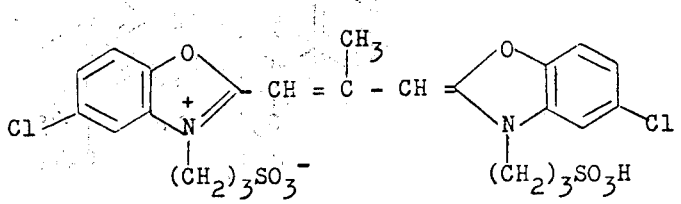

I - 14
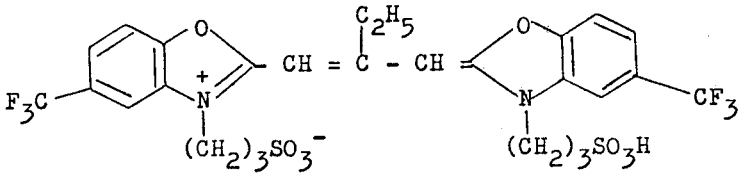
I - 15
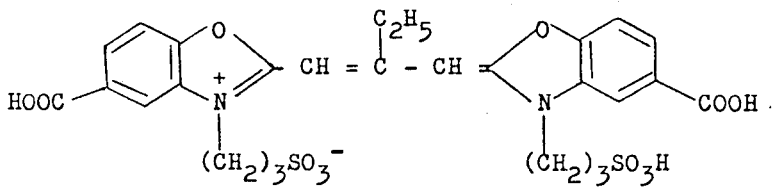
I - 16
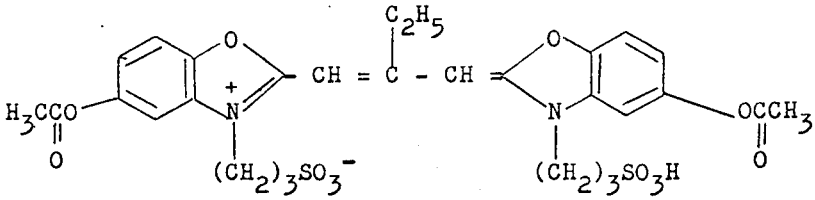
I - 17
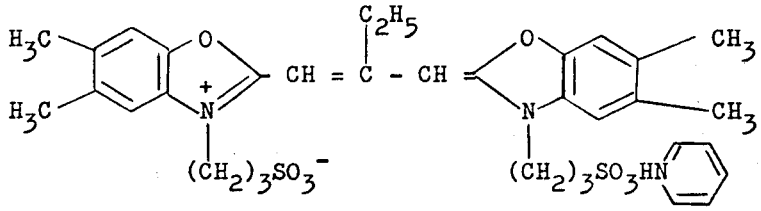
I - 18
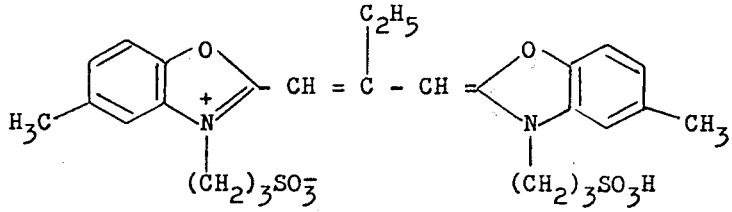
Typical examples of the spectral sensitizer represented by the general formula (II) as described below. However, the scope of the present invention is not to be construed as being limited thereby.
II - 1
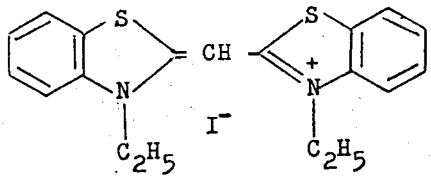
II - 2
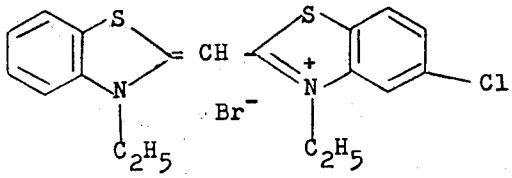

II - 3
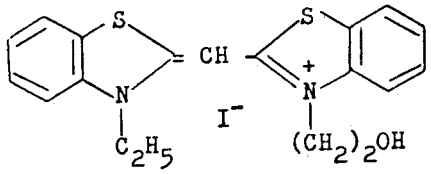
II - 4
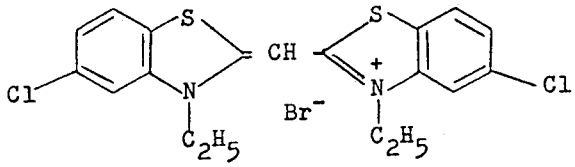
II - 5
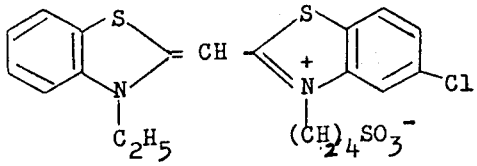
II - 6
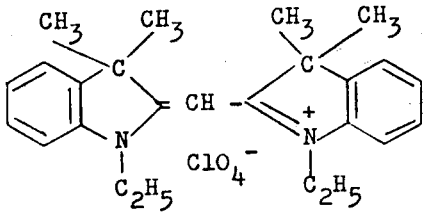
II - 9
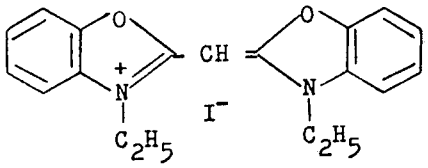
II - 10
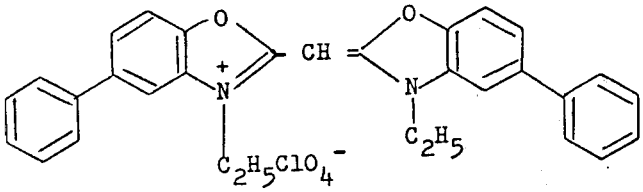
II - 11
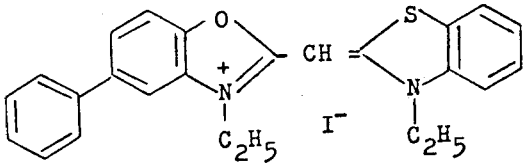
II - 12
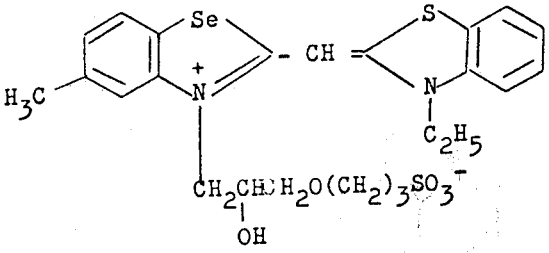

II - 13
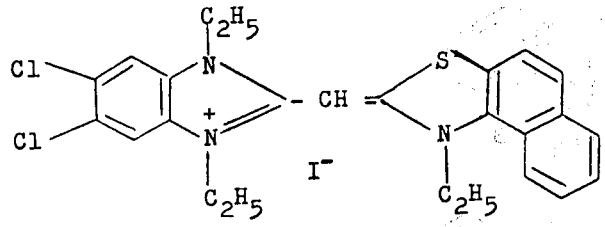
II - 14
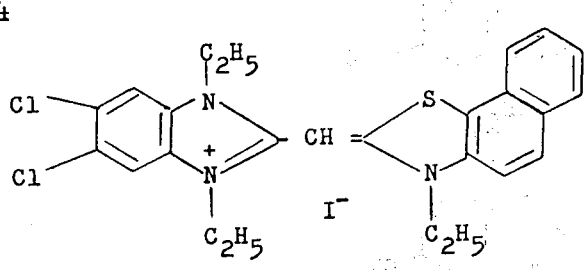
II - 15
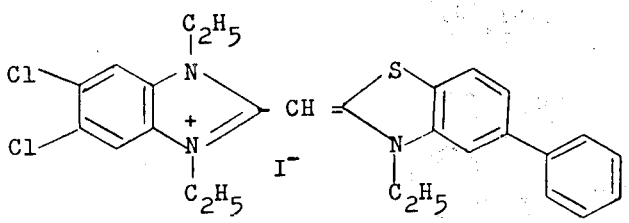
II - 16
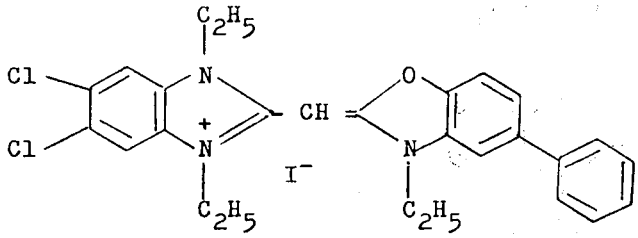
II - 17
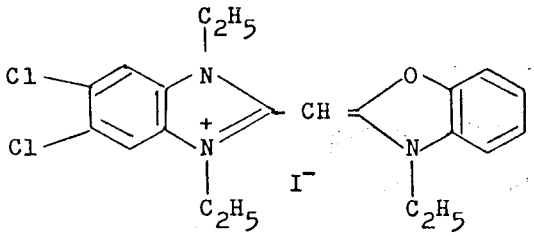
II - 18
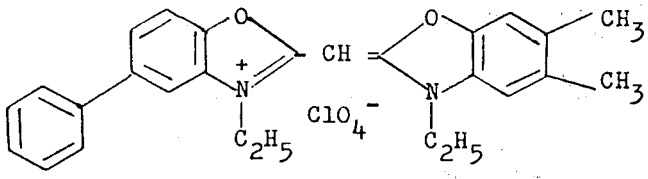
II - 19
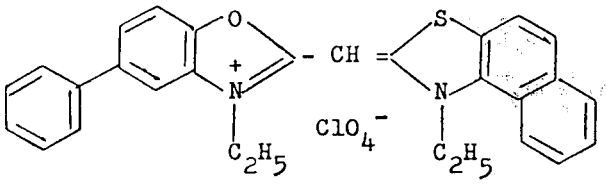

II - 20

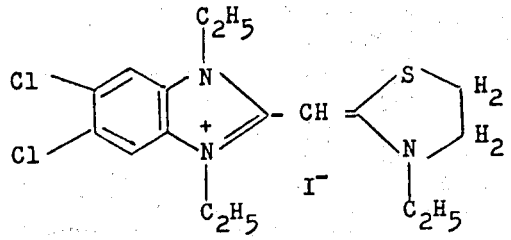

II - 21

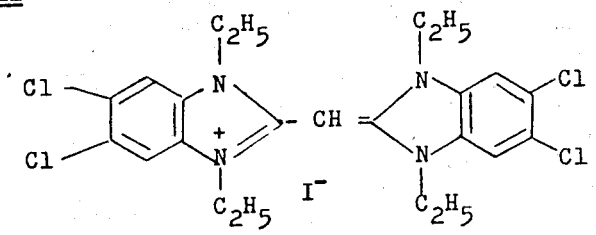

II - 22

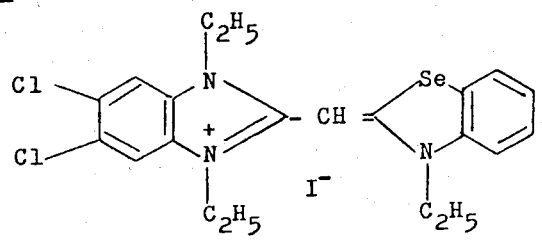

II - 23

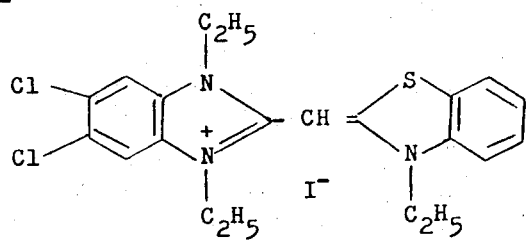

II - 24

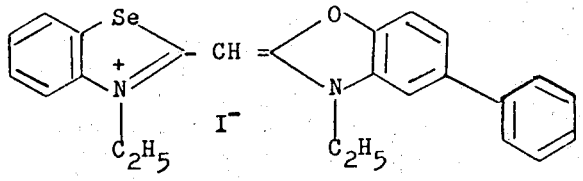

II - 25

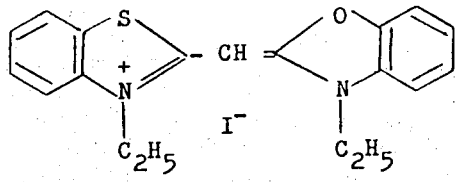

The spectral sensitization of the present invention is particularly useful for photographic emulsions comprising gelatin and silver halide. It is also useful for emulsions comprising hydrophilic polymers other than gelatin such as, e.g., agar, collodion, water soluble cellulose derivatives, polyvinyl alcohol, polyvinylpyrolidone, copolymers containing vinylpyrrolidone, other synthetic hydrophilic polymers, natural hydrophilic polymers, and gelatin derivatives. Suitable gelatin derivatives include those formed by the reaction of gelatin with aromatic sulfonyl chlorides, aromatic acid chlorides, aromatic acid anhydrides, isocyanates, 1,4-diketones, as disclosed in U.S. Pat. No. 2,614,928, trimellitic acid, as disclosed in U.S. Pat. No. 3,118,766, organic acids having an active halogen, as disclosed in Japanese Pat. Application No. 5514/1964, aromatic glycidyl ethers as disclosed in Japanese Pat. application 26845/1967, maleimides, maleamic acid, unsaturated aliphatic diamides as disclosed in U.S. Pat. No. 3,186,846, sulfoalkylated gelatin as disclosed in British Pat. No. 1,033,189, polyoxyalkylene derivatives as disclosed in U.S. Pat. No. 3,312,553 and polymer-grafted gelatins, e.g., grafted with acrylic acid, methacrylic acid, acrylate esters, methacrylate esters, acrylamide, acrylonitrile, styrene, etc. Specific examples of synthetic hydrophilic polymers, include homopolymers or copolymers of vinylalcohol, N-vinylpyrrolidone, hydroxyalkylmethacrylate, methacrylamide, N-substituted methacrylamide, etc., copolymers of these monomers with methacrylic esters, vinyl acetate, styrene, etc., and a monomer as described previously copolymerized with maleic anhydride, maleic acid, etc.

Although the silver halide used for the present invention is not limited provided that it is sensitive to light, those comprising a mixed halogen are particularly suitable and can be selected from more than one of silver chloride, silver bromide, and silver iodide. In addition, conventionally known sensitizing methods can be applied using conventional techniques, including chemical sensitization such as, e.g., using the natural sensitizers in gelatin, sulfur sensitizers such as the thiosulfates and sulfur compounds such as disclosed in U.S. Pat. Nos. 1,574,944, 2,278,947, 2,410,689, 3,189,458, 3,501,313 and French Pat. No. 2,059,245, reduction sensitizers such as the stannous salts as disclosed in U.S. Pat. No. 2,487,850, amines as disclosed in U.S. Pat. Nos. 2,518,698, 2,521,925, 2,521,926, 2,419,973, and 2,419,975, imino-amino-methane sulfinic acid as disclosed in U.S. Pat. No. 2,983,610, silanes as disclosed in U.S. Pat. No. 2,694,637, and the method disclosed by H. W. Wood in Journal of Photographic Science, 1, (1953) p.163, or gold sensitization or sensitization with Group VIII metals such as using a gold complex as disclosed in U.S. Pat. No. 2,399,083, or platinum, iridium, ruthenium, rhodium, palladium noble metals as disclosed in U.S. Pat. Nos. 2,448,060, 2,540,086, 2,566,245, and 2,566,263, and selenium compounds as disclosed in U.S. Pat. No. 3,297,446, etc. A combination of these methods can be employed, if desired.

To produce a photographic emulsion spectrally sensitized in accordance with the present invention, one or more sensitizers represented either by the general formula (I) or (II) can be incorporated into an emulsion using any conventional technique.

Usually, the sensitizer is added in the form of solution using a solvent such as methanol, ethanol, water, cellosolve, or a water soluble ketone (e.g., acetone). The sensitizer can be also added after being dissolved in an oil which is sparingly soluble in water, or after being dispersed in water or a hydrophilic colloid. The weight ratio of the dye (I) to the dye (II) can be varied broadly ranging from about 10:1 to 1:10 according to the effect desired. The amount of each dye employed preferably ranges from about $1 \times 10^{-6}$ to $1 \times 10^{-3}$ mol per 1 mol silver, depending on the nature of the emulsion.

The photographic emulsion prepared according to the present invention can be further subjected to other supersensitization procedures including the methods described in U.S. Pat. Nos. 2,977,229; 3,703,377; 2,688,545; 3,397,060; 3,615,635; 3,628,964; 3,718,475; 3,615,641; 3,511,664; 3,522,052; 3,527,641; 3,615,613; 3,615,632; 3,617,295; and 3,635,721 and German OLS 2,257,751. In the preparation of the photographic emulsion in accordance with the present invention, usual additives can be employed including e.g., stabilizers, and anti-foggants, e.g., mercury compounds such as the mercury complexes disclosed in U.S. Pat. No. 2,728,664, the mercury salt of benzthiazole disclosed in U.S. Pat. No. 2,728,667, the mercury addition compounds as disclosed in U.S. Pat. Nos. 2,728,663 and 2,732,302, organic mercury compounds as disclosed in U.S. Pat. No. 2,728,665, azoles such as the benzthiazolium salts as disclosed in U.S. Pat. No. 2,131,038; aminobenzimidazole as disclosed in U.S. Pat. No. 2,324,123, nitrobenzimidazole as disclosed in British Pat. No. 403,789, nitroamino-benzimidazole as disclosed in U.S. Pat. No. 2,324,123, mercaptothiazole derivatives as disclosed in U.S. Pat. No. 2,824,001, mercaptobenzthiazole derivatives as disclosed in U.S. Pat. No. 2,697,099, mercaptoimidazole derivatives as disclosed in U.S. Pat. No. 3,252,799, mercaptooxadiazole as disclosed in U.S. Pat. No. 2,843,491, mercaptothiadiazole as disclosed in U.S. Pat. No. 1,758,576, phenylmercaptotetrazole as disclosed in U.S. Pat. No 2,403,927, mercaptopyrimidine as disclosed in U.S. Pat. No. 2,304,962, mercaptotriazine as disclosed in U.S. Pat. No. 2,476,536, mercaptotetrazaindene as disclosed in British Pat. No. 893,428, thiosalicylic acid as disclosed in U.S. Pat. No. 2,377,375, thiobenzoic acid as disclosed in U.S. Pat. No. 3,226,231, sugar mercaptal as disclosed in Japanese Pat. application No. 8743/1972, oxazoline thione as disclosed in U.S. Pat. No. 3,251,691, triazolothiadiazol as disclosed in Japanese Pat. application 17932/1968, azaindenes such as the tetrazaindenes as disclosed in U.S. Pat. Nos. 2,444,605, 2,444,606 and 2,450,397, and Japanese Pat. application Nos. 10166/1964, and 10516/1967, pentazaindenes as disclosed in U.S. Pat. No. 2,713,541 and Japanese Pat. application No. 13495/1968, and urazole as disclosed in U.S. Pat. No. 2,708,161; image tone controllers; hardening agents, e.g., aldehydes, such as glyoxal as disclosed in U.S. Pat. No. 1,870,354, glutalaldehyde as disclosed in British Pat. No. 825,544, N-methylol substituted compounds, such as N,N'-dimethylolurea, dioxane derivatives, e.g., dihydroxydioxane as disclosed in U.S. Pat. No. 3,380,829, compounds having epoxy groups, as disclosed in U.S. Pat. Nos. 3,047,394 and 3,091,537, compounds having active halogens, such as 2,4-dichloro-6-hydroxy-1,3,5-triazine as disclosed in U.S. Pat. No. 3,325,287, muco-halic acids such as mucochloric acid and mucobromic acid as disclosed in U.S. Pat. No. 2,080,019, bis-(methane sulfonic acid ester) as disclosed in U.S. Pat. No. 2,726,162, sulfonyl compounds such as bis-(benzene sulfonyl chloride) as disclosed in U.S. Pat. No. 2,725,295, aziridine compounds, divinylsulfones as disclosed in U.S. Pat. No. 2,579,871, compounds having active olefinic bonds such as divinyl ketone as disclosed in German Pat. No. 872,153, compounds having acryloyl groups as disclosed in U.S. Pat. Nos. 3,255,000 and 3,635,718, British Pat. No. 994,869 and German Pat. No. 1,090,427, alkylene bis-maleimide as disclosed in U.S. Pat. No. 2,992,109, isocyanates as disclosed in U.S. Pat. No. 3,103,437, carbodiimides as disclosed in U.S. Pat. No. 3,100,704, isooxazol derivatives as disclosed in U.S. Pat. Nos. 3,321,313 and 3,543,292, polymeric hardeners such as dialdehyde starch as disclosed in U.S. Pat. No. 3,057,723, and inorganic hardeners, such as chrom alum, chrom acetate, zirconium sulfate, etc.; surface active agents, e.g., nonionic surface active agents, such as saponin, polyethyleneglycol, polyethylene glycol/polypropylene glycol adducts as disclosed in U.S. Pat. No. 3,294,540, polyalkyleneglycol ethers, esters, and amides as disclosed in U.S. Pat. No. 2,831,766, anionic surface active agents, such as alkyl carboxylic acid salts, alkylsulfonic acid salts, alkylbenzene sulfonic acid salts, alkylnaphthalene sulfonic acid salts, alkyl sulfates, N-acyl-N-alkyltaurine as disclosed in U.S. Pat. No. 2,739,891, maleopimalates as disclosed in U.S. Patent Nos. 2,359,980, 2,409,930 and 2,447,750, other anionic surface active agents as disclosed in U.S. Pat. Nos. 2,823,123 and 3,415,649, amphoteric surface active agents, e.g., as disclosed in U.S. Pat. No. 3,726,683 and British Pat. No. 1,159,825, etc.; plasticizers such as glycerine, diols as disclosed in U.S. Pat. No. 2,960,404, aliphatic triols as disclosed in U.S. Pat.

No. 3,520,694, etc.; sensitizers and development accelerators such as ethers, esters, or amides of polyalkylene oxides as disclosed in U.S. Pat. No. 2,708,161, other polyalkylene oxide derivatives as disclosed in British Pat. No. 1,145,186, quarternary ammonium salts as disclosed in U.S. Pat. No. 3,772,021, thio-ether compounds as disclosed in U.S. Pat. Nos. 3,046,132 to 3,046,135, thiomorpholines, pyrrolidines, derivatives of urethane or urea, imidazole derivatives, 3-pyrazolidones, and organic mercury compounds as disclosed in U.S. Pat. Nos. 2,728,665 and 3,420,668; color couplers; fluorescent brightening agents such as the stilbenes, triazines, oxazoles, coumarins, etc.; ultraviolet absorbers such as the benzophenones, the benzotriazoles, the thiazolidines, etc.; matting agents such as silica as disclosed in Swiss Pat. No. 330,158, glass powders as disclosed in French Pat. No. 1,296,995, carbonates of alkaline earth metals, cadmium or zinc as disclosed in British Pat. No. 1,173,181, starch as disclosed in U.S. Pat. No. 2,322,037, starch derivatives as disclosed in British Pat. No. 981,198, polyvinylalcohol as disclosed in Japanese Pat. application No. 3643/1969, polystyrene particles, polymethylmethacrylate particles, polyacrylonitrile particles as disclosed in U.S. Pat. No. 3,079,257, polycarbonate particles as disclosed in U.S. Pat. No. 3,022,169, etc.; lubricating agents such as the higher alcohol esters of higher fatty acids as disclosed in U.S. Pat. Nos. 2,588,756, and 3,121,060, casein as disclosed in U.S. Pat. No. 3,295,979, the calcium salt of higher fatty acids as disclosed in British Pat. No. 1,263,722, silicone compounds as disclosed in U.S. Pat. Nos. 3,042,522 and 3,489,567, dispersed liquid paraffin, etc.

The photographic emulsion of the present invention can be coated on any suitable support such as, e.g., glass, ceramic, metal, films of polymers such as cellulose derivatives such as cellulose nitrate, cellulose acetate, cellulose acetate-butyrate, etc., polyethylene terephthalate, polyalkylmethacrylate, polystyrene, polyvinyl chloride, polyvinyl alcohol, partly formalized polycarbonate, polyamide, etc., baryta paper, resin coated paper or synthetic paper using conventional techniques.

The silver halide photographic emulsion of the present invention can also be applied to material suited for recording CRT displays.

Some specific examples of the present invention are described hereinbelow, however, they are given for the purpose of illustration, and not for limitation. Unless otherwise indicated, all parts, percents, and the like are by weight.

EXAMPLE 1

A series of silver halide photographic emulsions were prepared by adding to a silver iodobromide emulsion (AgI:AgBr= 3 mol %: 97 mol %; gelatin/$AgNO_3$ = 1.0; 0.28 mol silver salt/Kg emulsion; silver coating amount: 0.04 mol Ag/$m^2$) various combinations of sensitizers represented by the general formulae (I) and (II) shown in Table 2 in the amounts also shown in Table 2. Each emulsion was coated on a cellulose triacetate film. After drying, the film was exposed to light having an intensity of 64 lux and a color temperature of 5400°K through a green filter produced by Fuji Photo Film Co., and then was developed at 24°C for 2 min. The formulation of the developer used is given in Table I.

TABLE I

| | |
|---|---|
| Metol | 2.2 g |
| Sodium Sulfite | 96 g |
| Hydroquinone | 8.8 g |
| Sodium Carbonate (monohydrate) | 56 g |
| Potassium Bromide | 5 g |
| Water to make | 1 liter. |

In Table II, the green light sensitivity is given as a relative value, for each emulsion which contains either one sensitizer alone or two sensitizers in combination.

Table II

| Sample No. | Spectral Sensitizer (concn. $10^{-4}$ mol/Kg emulsion) | | Spectral Sensitizer (concn. $10^{-4}$ mol/Kg emulsion) | | Relative Sensitivity to Green Light | Sensitivity Maximum Wave length* (nm) |
|---|---|---|---|---|---|---|
| 1 | I-2 | (0.4) | — | | 67.0 | 552 |
| | I-2 | (0.8) | — | | 100 (standard) | " |
| | " | (1.2) | — | | 107 | " |
| | " | (1.6) | — | | 105 | " |
| 2 | | — | II-1 | (0.2) | (below 5) | — |
| | | — | " | (0.4) | " | — |
| | | — | " | (0.8) | " | — |
| 3 | I-2 | (0.8) | II-1 | (0.1) | 112 | 552 |
| | " | (0.8) | " | (0.2) | 112 | " |
| | " | (1.2) | " | (0.2) | 115 | " |
| 4 | | — | II-5 | (0.1) | (below 5) | — |
| | | — | " | (0.2) | " | — |
| | | — | " | (0.4) | " | — |
| 5 | I-2 | (0.8) | II-5 | (0.1) | 118 | 552 |
| | " | (0.8) | " | (0.2) | 115 | " |
| | " | (1.2) | " | (0.2) | 118 | " |
| 6 | | — | II-10 | (0.1) | (below 5) | — |
| | | — | " | (0.2) | " | — |
| | | — | " | (0.4) | " | — |
| 7 | I-2 | (0.8) | II-10 | (0.1) | 115 | 552 |
| | " | (1.2) | " | (0.2) | 112 | " |
| | " | (1.2) | " | (0.1) | 115 | " |

*The values of wavelength were obtained using a Type GR-II spectrophotometer produced by Narumi Shokai, provided with a light source of a color temperature of 2666°K.

EXAMPLE 2

To a silver iodobromide photographic emulsion (AgI:AgBr = 1.5 mol %: 98.5 mol %; gelatin/$AgNO_3$ = 0.4; 0.75 mol silver salt/Kg emulsion; silver coating amount:0.04 mol Ag/$m^2$) were added various sensitizers which have been illustrated earlier and are used in the present invention solely or in combination. Each emulsion was coated on a film of polyethylene terephthalate and dried. The dried film was subjected to x-ray radiation and then to development.

The x-ray radiation was carried out in the following way. The film was brought into an intimate contact with a fluorescent screen sheet coated with terbium activated gadolinium oxysulfide ($Gd_2O_2S$) having the fluorescent spectrum shown in FIG. 2, further, an optical wedge was inserted between the film and the screen sheet and an x-ray flux of 25 milliroentgen was irradiated on the screen. The exposed film was developed in an automatic processor containing a developer having the following composition.

| | Temperature | Time |
|---|---|---|
| Developing | 35°C | 25 sec. |
| Fixing | 34°C | 25 sec. |
| Washing with Water | 33°C | 25 sec. |
| Drying | 45°C | 15 sec. |
| Water | | 500 ml |
| Hydroxyethylethylenediamine Acetate | | 0.8 g |
| Sodium Sulfite (anhydrous) | | 50.0 g |
| Potassium Hydroxide | | 20.0 g |
| Hydroquinone | | 25.0 g |
| 1-Phenyl-3-pyrazolidone | | 1.5 g |
| Boric Acid | | 10.0 g |
| Triethyleneglycol | | 25.0 g |
| Glutaraldehyde | | 5.0 g |
| Glacial Acetic Acid | | 3.0 g |
| Sodium Bisulfite (anhydrous) | | 4.5 g |
| 5-Nitro-indazole | | 0.03 g |
| 1-Phenyl-5-mercaptotetrazole | | 0.005 g |
| Water to make | | 1.0 liter |

The pH value of the developing solution at 20°C is about 10.30.

Table III shows the relative sensitivity value for each emulsion which contains one or more spectral sensitizers already illustrated. The sensitivity is defined as proportional to the reciprocal of the exposure amount required to give an optical density 0.5 above the fog density.

TABLE III

| Sample No. | Spectral Sensitizer (concn. $10^{-4}$ mol/Kg. emulsion) | | Spectral Sensitizer (concn. $10^{-4}$ mol/Kg. emulsion) | | Relative Sensitivity | Sensitivity Maximum Wavelength* (nm) |
|---|---|---|---|---|---|---|
| 8 | — | | — | | 15 | — |
| 9 | I-6 | (0.8) | — | | 100 (standard) | 550 |
| | " | (1.2) | — | | 105 | " |
| | " | (1.6) | — | | 95.5 | " |
| 10 | — | | II-4 | (0.1) | 15 | — |
| | — | | " | (0.2) | 15 | — |
| 11 | I-6 | (0.8) | II-4 | (0.1) | 130 | 550 |
| | " | (0.8) | " | (0.2) | 126 | 545 |
| 12 | I-2 | (0.8) | — | | 100 | 552 |
| | " | (1.2) | — | | 105 | " |
| | " | (1.6) | — | | 105 | " |
| | | | — | | 105 | " |
| 13 | — | | II-16 | (0.1) | 15 | — |
| | — | | " | (0.2) | 13 | — |
| 14 | I-2 | (0.8) | II-16 | (0.2) | 135 | 550 |
| | " | (1.2) | " | (0.1) | 132 | 552 |

*Same as in Table II.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing in a supersensitizing amount the combination of at least one sensitizing dye represented by the general formula (I)

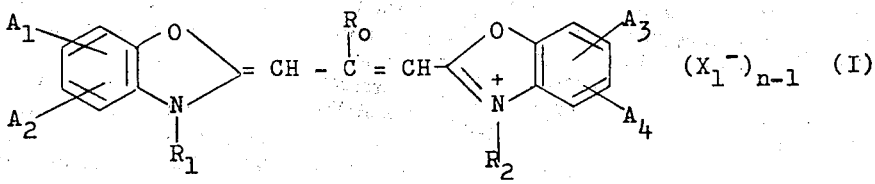

$(X_1^-)_{n-1}$ (I)

wherein, $A_1$, $A_2$, $A_3$ and $A_4$ each represents a member selected from the group consisting of a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamido group, an acyloxy group, an alkoxycarbonylamino group, and a carbalkoxy group; and $A_1$ and $A_2$ and $A_3$ and $A_4$ can combine to form a naphthoxazole nucleus; $R_o$ represents a hydrogen atom, a lower alkyl group or an aryl group; $R_1$ and $R_2$ each represents an alkyl group, provided that at least one of $R_1$ or $R_2$ represents a sulfoalkyl group; $X_1$ represents an anion; and n is equal to 1 or 2 with n being equal to 1 when the sensitizing dye forms an intramolecular salt, and at least one sensitizing dye represented by the general formula (II)

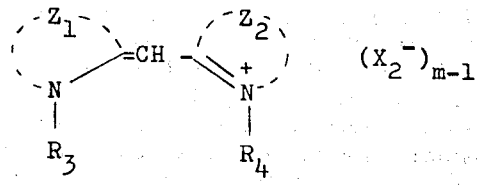

$(X_2^-)_{m-1}$ (II)

wherein $Z_1$ and $Z_2$ each represents the non-metallic atoms necessary to form a nucleus selected from the group consisting of a thiazole nucleus, a thiazoline nucleus, an oxazole nucleus, a selenazole nucleus, a 3,3-dialkylindolenine nucleus and an imidazole nucleus; $R_3$ and $R_4$ each represents an alkyl group; $X_2$ represents an anion; m is equal to 1 or 2 with m being equal to 1 when the sensitizing dye forms an intramolecular salt.

2. The silver halide photographic emulsion of claim 1, wherein said lower alkyl group for $A_1$ to $A_4$ has from 1 to 4 carbon atoms, wherein said alkoxy group for $A_1$ to $A_4$ has from 1 to 4 carbon atoms in the alkyl moiety thereof, wherein said aryl group for $A_1$ to $A_4$ is a monoaryl group, wherein said alkoxycarbonyl group for $A_1$ to $A_4$ has from 1 to 4 carbon atoms in the alkyl moiety thereof, wherein said amino group for $A_1$ to $A_4$ is an amino group or a lower alkyl amino group, wherein said alkoxycarbonyl amino group for $A_1$ to $A_4$ has 1 to 4 carbon atoms in the alkyl moiety thereof, and wherein said carbalkoxy group for $A_1$ to $A_4$ has from 1 to 4 carbon atoms in the alkyl moiety thereof, wherein the naphthoxazole nucleus formed by $A_1$ and $A_2$ and by $A_3$ and $A_4$ is a naphthol (2,1-d)oxazole nucleus, a naphtho(1,2-d)oxazole nucleus, or a naphtho(2,3-d)oxazole nucleus, wherein the lower alkyl group for $R_o$ has from 1 to 4 carbon atoms and wherein said aryl group for $R_o$ is a mono-aryl group, wherein the alkyl group for $R_1$ and $R_2$ is an unsubstituted alkyl group having 1 to 8 carbon atoms or a substituted alkyl group, in which the alkyl moiety has from 1 to 4 carbon atoms and the substituents are selected from the group consisting of hydroxy, acetoxy, alkoxyalkyl, carboxyalkyl, sulfoalkyl, and aralkyl; and wherein the alkyl groups for $R_3$ and $R_4$ have the same meaning as the alkyl groups for $R_1$ and $R_2$.

3. The silver halide photographic emulsion of claim 1, wheren at least one of $A_1$, $A_2$, $A_3$, and $A_4$ is a halogen atom.

4. The photographic emulsion of claim 1, wherein at least one of $Z_1$ and $Z_2$ is a nucleus selected from the group consisting of benzothiazole, benzimidazole, naphthothiazole and benzoxazole.

5. The silver halide photographic emulsion of claim 1, wherein said sensitizing dye represented by the General Formula (I) is an anhydro-9-ethyl-5,5′-dichloro-3,3′-disulfopropyl-oxacarbocyanine hydroxide.

6. The silver halide photographic emulsion of claim 1, wherein said silver halide is silver chloride, silver bromide, silver iodide, silver chlorobromide, silver chloroiodide or silver chlorobromoiodide.

7. The silver halide photographic emulsion of claim 1, wherein the emulsion comprises a hydrophilic binder and the amount of each of the sensitizing dyes of the General Formula (I) and the General Formula (II) ranges from about $1 \times 10^{-6}$ to $1 \times 10^{-3}$ mol per 1 mol of silver.

8. The silver halide photographic emulsion of claim 7, wherein the weight ratio of the sensitizing dye of the General Formula (I) to the sensitizing dye of the General Formula (II) ranges from about 10:1 to 1:10.

9. A photosensitive photographic material comprising a support having thereon a layer of the silver halide photographic emulsion of claim 1.

10. The photosensitive photographic material of claim 9, wherein said material is an X-ray recording photographic material comprising a silver iodobromide emulsion containing iodine at a content not higher than 4 mol %.

11. A method of recording X-rays comprising imagewise exposing the photographic material of claim 10 to the radiation emitted from a fluorescent screen comprising the oxysulfide of yttrium or a lanthanide element activated with a rare earth metal element as the fluorescent material and developing said photographic material.

* * * * *